US007207608B2

(12) United States Patent
Monts de Oca

(10) Patent No.: US 7,207,608 B2
(45) Date of Patent: Apr. 24, 2007

(54) SYSTEM, METHOD AND APPARATUS FOR AN ADJUSTABLE DOOR STRIKER

(76) Inventor: Jerry L. Monts de Oca, 12421 Citation Rd., Spring Hill, FL (US) 34610-4823

( * ) Notice: Subject to any disclaimer, the term of this patent is extended or adjusted under 35 U.S.C. 154(b) by 98 days.

(21) Appl. No.: 11/184,211

(22) Filed: Jul. 19, 2005

(65) Prior Publication Data

US 2007/0029822 A1 Feb. 8, 2007

(51) Int. Cl.
*E05B 15/02* (2006.01)

(52) U.S. Cl. ..... 292/341.18; 292/DIG. 60

(58) Field of Classification Search ..... 292/340, 292/341.18, 341.19, DIG. 60
See application file for complete search history.

(56) References Cited

U.S. PATENT DOCUMENTS 1,272,115 A * 7/1918 Russell ..... 292/341.19
1,448,035 A * 3/1923 Ottinger ..... 292/341.19
3,006,677 A * 10/1961 Royalty ..... 292/341.18
3,257,139 A * 6/1966 Russell et al. ..... 292/341.18
5,570,917 A 11/1996 Cutrer
6,318,772 B1 11/2001 Pearson
6,834,897 B1 12/2004 Walker

* cited by examiner

*Primary Examiner*—Gary Estremsky
(74) *Attorney, Agent, or Firm*—Larson & Larson, PA; Frank Liebenow

(57) ABSTRACT

An adjustable striker plate assembly for a double door having a slidable member providing for adjustment of the striker plate in a horizontal direction and an adjustable member for adjusting the striker plate in a vertical direction. Two fasteners pass through the striker plate and through the slidable member and into two threaded holes in the adjustable member. A cam is rotatably coupled to the adjustable member for adjusting and holding the adjustable member in place until the fasteners are tightened.

19 Claims, 4 Drawing Sheets

SYSTEM, METHOD AND APPARATUS FOR AN ADJUSTABLE DOOR STRIKER

BACKGROUND OF THE INVENTION

1. Field of the Invention

This invention relates to the field of door striker plate assemblies and more particularly to a system and apparatus for an adjustable door striker plate.

2. Description of the Related Art

In conventional practice, entryway strikers are deployed to accept door locks and deadbolts, holding a door shut when the bolt is within an opening of the striker. A simple striker is generally fabricated from metal having an opening slightly larger than the bolt and an engaging surface that is angled so that as the door closes, the angle of the striker engages with the spring tensioned bolt, pushing the bolt inwardly into the door lock assembly until the bolt passes over the opening, where the spring forces the bolt into the opening, holding the door closed. Often, two screws hold the striker to the doorframe. Being that the doorframe is usually pre-drilled to accept this common striker, the striker's location is fixed, making adjustments to accommodate manufacturing and installation variances very difficult.

The same issue is present in double door installations. In a double door installation, the striker is mounted on the inactive door and the door lock or deadbolt is mounted on the active door. Since both the active and inactive door is hinged, even more variations in installation are possible, making it very difficult to align the striker with the door lock or deadbolt when the striker is installed in a fixed position.

What is needed is a striker system that will provide for horizontal height adjustment and vertical depth adjustment to permit the striker to align with the deadbolts and door locks.

SUMMARY OF THE INVENTION

In one embodiment, a striker plate is disclosed including an opening adapted to receive a lock bolt, and a pair of holes. Also included are a slidable member for adjusting the striker plate in a horizontal direction having a pair of oblong holes and an adjustable member for adjusting the striker plate in a vertical direction having a pair of threads. A pair of fasteners passes through the pair of holes in the striker plate and through the pair of oblong holes in the slidable member and into the pair of threads in the adjustable member. A cam is rotatably coupled to the adjustable member for adjusting and holding the adjustable member in place until the pair of fasteners is tightened.

In another embodiment, a method for adjusting a striker plate is disclosed including providing a striker plate assembly adapted into a channel of an inactive door of a double door system, the inactive door has a side edge for interfacing with an active door. The striker plate assembly has a striker plate with an opening adapted to receive a lock bolt, and two holes. The striker plate assembly also has a slidable member for adjusting the striker plate in a horizontal direction with two oblong holes and an adjustable member for adjusting the striker plate in a vertical direction with a pair of threads. Two fasteners pass through the two holes in the striker plate, through the two oblong holes in the slidable member and into the threads in the adjustable member. A cam is rotatably coupled to the adjustable member for horizontally adjusting the adjustable member and holding the adjustable member in place. The method continues with positioning the striker plate assembly in the vertical direction by sliding the striker plate assembly within the channel and adjusting the striker plate assembly in the horizontal direction by inserting a tool into a slot in the cam and rotating the cam until a desired location is achieved. Once positioned, the fasteners are tightened, thereby holding the striker plate assembly in position by holding the adjustable member against the slidable member and by holding the slidable member against the channel.

In another embodiment, a striker plate system is disclosed including a channel within a side edge of an inactive door of a double door system, the side edge interfaces with an active door of the double door. Included is a striker plate with an opening adapted to receive a lock bolt and two holes; a slidable member for adjusting the striker plate in a horizontal direction with two oblong holes; and an adjustable member for adjusting the striker plate in a vertical direction with two threaded holes. Two fasteners pass through the holes in the striker plate and through the pair of oblong holes in the slidable member and into the threaded holes in the adjustable member. A cam is rotatably coupled to the fixed member for holding the fixed member in place while the fasteners are tightened; the slidable member is forced against the channel when the pair of fasteners is tightened.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
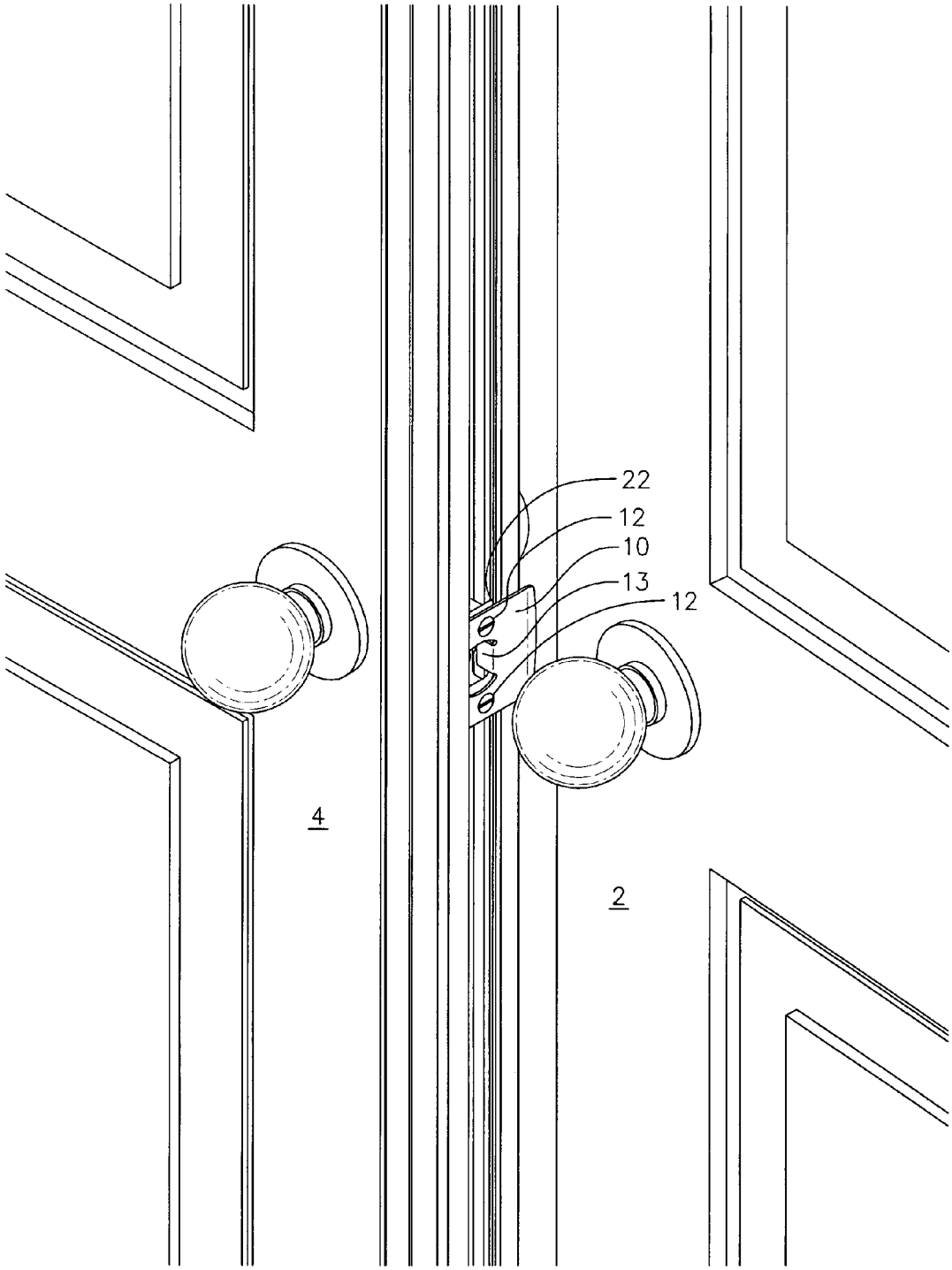
FIG. 1 illustrates a view of a door system of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Figure 2:
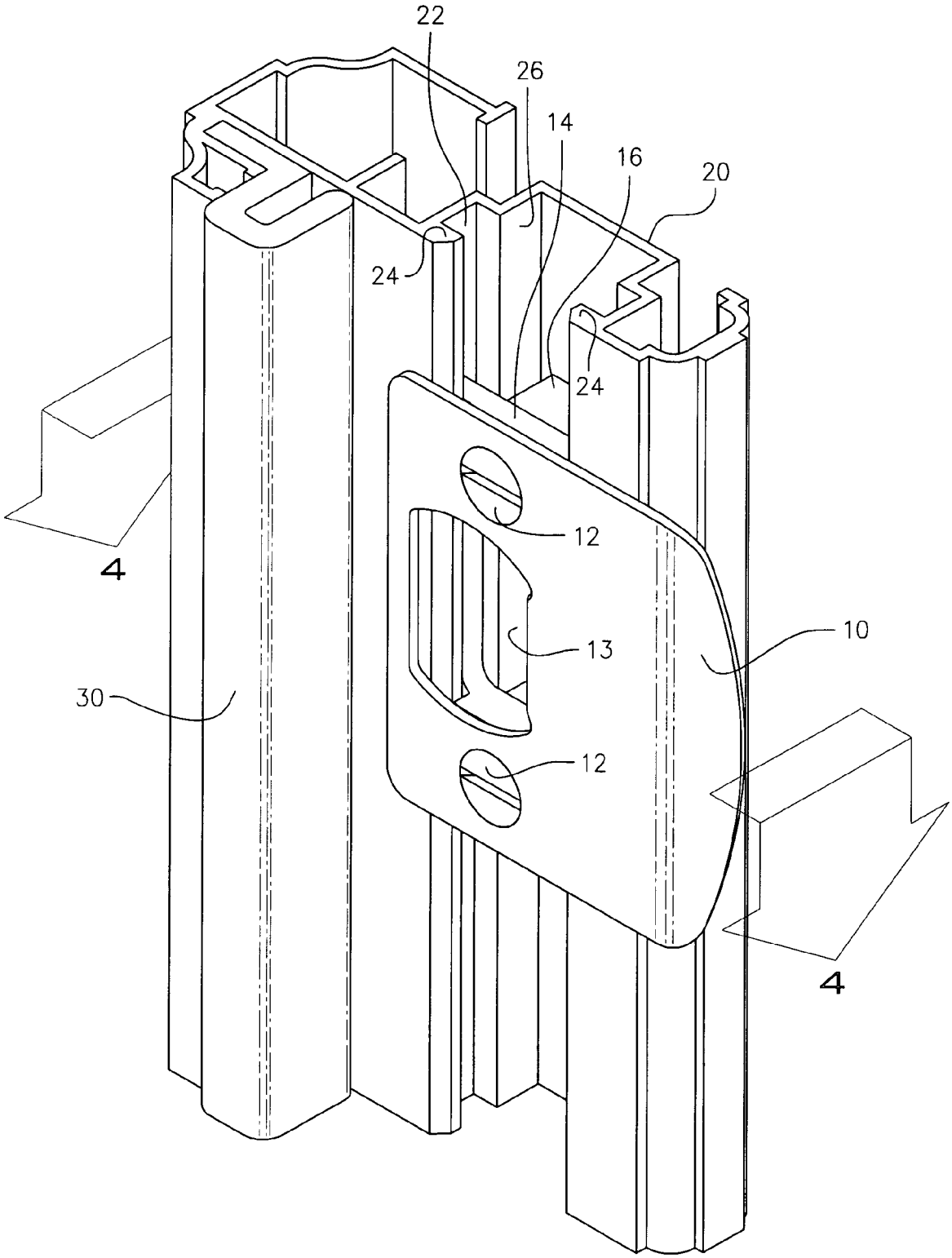
FIG. 2 illustrates a view of the striker of the first embodiment of the present invention installed in a track of the inactive door.
Figure 3:
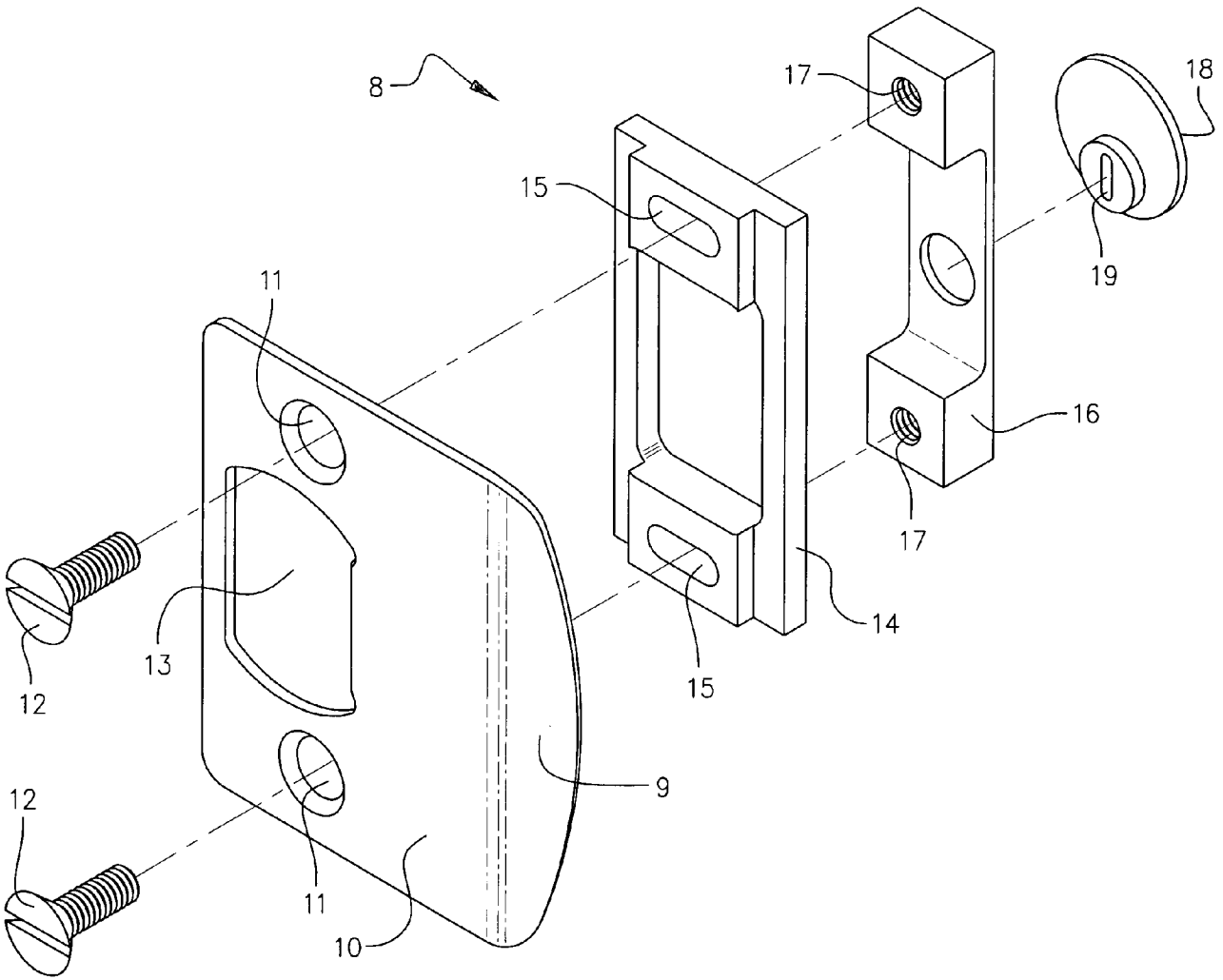
FIG. 3 illustrates an exploded view of the first embodiment of the present invention.
Figure 4:
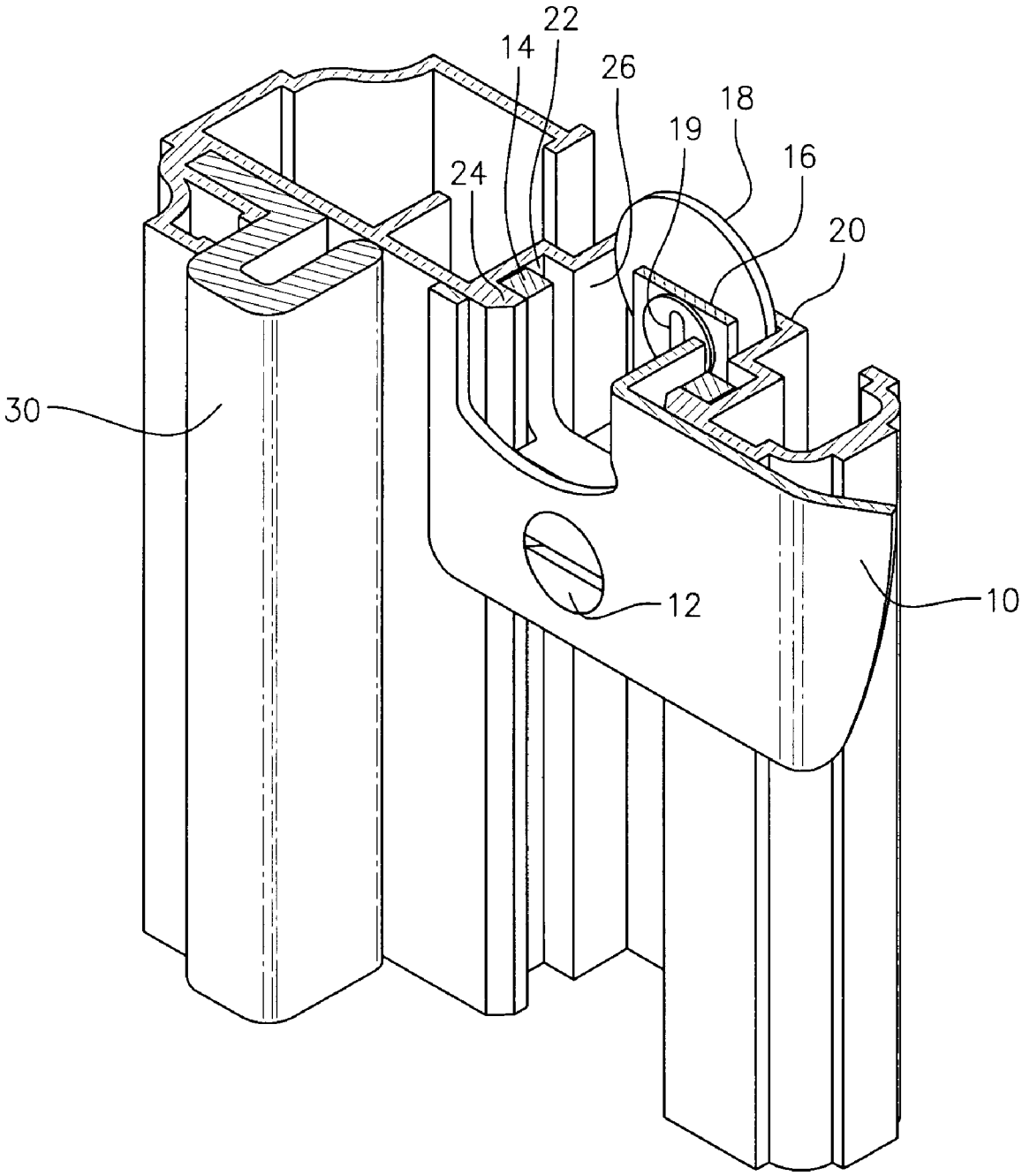
FIG. 4 illustrates a cross-sectional view of the striker of the first embodiment along line 4—4 of FIG. 2.

Referring to FIG. 1, a door system of the present invention is shown. Component numbers from FIGS. 2–4 are referenced for clarity. An inactive door 4 is shown with the striker plate assembly 8 installed in a channel 22. Generally, the inactive door is fixed in place by one or two flush bolts, providing bolts that extend into the doorframe, holding the inactive door closed. During installation and during use, it may be required to adjust the position of the striker plate assembly 8 in a vertical direction to mate correctly with a bolt from a deadbolt lock or door latch (not shown). To accomplish this, the retaining screws 12 are loosened and the striker plate assembly 8 is repositioned within the channel 22, possibly by applying vertical force to the striker plate 10. Additionally, the tightness of the closure of the active door may be adjusted while the screws 12 are loose by placing a driver into a slot 19 of a cam 18 (not visible) and adjusting the horizontal location of the striker plate assembly, then tightening the screws 12 to hold the striker plate assembly in place, both horizontally and vertically.

Referring now to FIG. 2 a view of the striker of the first embodiment of the present invention installed in a track of the inactive door will be described. Component numbers from FIG. 1, FIG. 3 and FIG. 4 are referenced for clarity. The striker plate assembly 8 is installed in a channel 22 of the inactive door. The screws 12 pass through holes 11 in the striker plate 10 and through the slidable member 14 and into threads 17 (not visible) within the adjustable member 16. The cam 18 (not visible) pushes against the wall 26 of the channel to adjust the horizontal location of the striker assembly 8. Force applied by tightening the screws 12 hold the adjustable member 16 in position against the slidable member 14 and hold the slidable member in position against the lip 24 of the channel 22. In some embodiments, a weather strip 30 is provided. In some embodiments, the channel is formed as part of a separate section of structural material 20 such as aluminum, steel or plastic that is affixed to the edge of the inactive door. In some embodiments, the channel is formed by extruding or molding the structural material 20 before it is affixed to the door. In some embodiments, the channel is integrated into the edge of the inactive door.

Referring now to FIG. 3, an exploded view of the striker plate assembly 8 of the present invention will be described. A striker plate 10 is shown with an opening 13 for receiving the bolt of a deadbolt lock or door latch and two screw holes 11 through which two screws 12 pass. The screws 12 pass through the striker plate 10 and through oblong holes 15 in a slidable member 14 and screw into threads 17 in the adjustable member 16. Although the slidable member 14 and the adjustable member 16 can be fabricated out of many stiff structural materials, a hard plastic such as nylon is preferred. In some embodiments, the structural material of the adjustable member 16 is drilled and tapped to make the threads 17 for accepting the screws 12. In other embodiments, a hole is drilled and a threaded metal insert is forced into the hole to provide threads 17 with additional strength. In some embodiments, the striker plate 10 has an angled edge 9 for engaging with the bolt of the deadbolt lock or door latch.

The slidable member is shaped and sized to fit within a track of the inactive door so that it can be slid vertically to adjust its position. Additionally, the slidable member 14 has elongated holes 15 through which the screws 12 pass so that the screws and striker plate can move horizontally, adjusting the closure of the active door. The adjustable member 16 has a cam 18 for adjusting the horizontal position of the assembly by placing a tool such as a screw driver into a slot 19 in the cam 18 and turning until the horizontal position is correct. When the cam is turned, it places a force on the wall 26 of the track of the inactive door, positioning and holding the striker assembly in place while the screws 12 are tightened. When the screws 12 are tightened, the slidable member is pulled toward the striker plate, griping the track and holding the striker plate assembly 8 in place. Likewise, the adjustable member is forced against the slidable member, maintaining the striker plate's horizontal location.

Referring now to FIG. 4 a cross-sectional view of the striker along lines 4—4 of FIG. 2 installed in a track of the inactive door 4 will be described. The striker plate assembly 8 is installed in a channel 22 of the inactive door. The screws 12 pass through the striker plate 10 and through the slidable member 14 and into threads 17 (not visible) of the adjustable member 16. A tool such as a screw driver placed in the cam slot 19 and turned causes the cam 18 to push against one of the walls 26 of the channel 22 to adjust the horizontal location of the striker assembly 8. Force applied by tightening the screws 12 hold the adjustable member 16 in position against the slidable member 14 and hold the slidable member in position against the lip 24 of the channel 22. In some embodiments, a weather strip 30 is provided. In some embodiments, the channel 22 is formed by of a separate section of structural material 20 such as aluminum, steel or plastic that is affixed to the edge of the inactive door. In some embodiments, the channel 22 is formed by extruding or molding the structural material before it is affixed to the door. In some embodiments, the channel 22 is integrated into the edge of the inactive door.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An adjustable striker plate assembly comprising:

a striker plate having an opening adapted to receive a lock bolt, the striker plate having a pair of holes;

a slidable member for adjusting the striker plate in a horizontal direction, the slidable member having two oblong holes;

an adjustable member for adjusting the striker plate in a vertical direction, the adjustable member having two threaded holes;

two fasteners passing through the two holes in the striker plate and passing through the two oblong holes in the slidable member and into the two threaded holes in the adjustable member; and a cam rotatably coupled to the adjustable member for adjusting and holding the adjustable member in place until the two fasteners are tightened.

2. The adjustable striker plate assembly of claim 1, wherein the cam has a slot adapted to accept a tool for rotating the cam.

3. The adjustable striker plate assembly of claim 2, wherein the slidable member and the adjustable member and the cam are disposed within a channel located on an edge of an inactive door.

4. The adjustable striker plate assembly of claim 2, wherein the slidable member and the adjustable member and the cam are made from nylon.

5. The adjustable striker plate assembly of claim 4, the adjustable member further comprising two threaded metal inserts for accepting the two fasteners.

6. The adjustable striker plate assembly of claim 3, wherein the channel is formed of extruded metal and the channel is affixed to the edge of the inactive door.

7. The adjustable striker plate assembly of claim 3, wherein the channel is formed in the side edge of the inactive door.

8. The adjustable striker plate assembly of claim 1, wherein the striker plate has an angled edge.

9. A method for adjusting a striker comprising:

providing a striker plate assembly adapted into a channel of an inactive door of a double door system, the inactive door having a side edge for interfacing with an active door of the double door system, the striker plate assembly comprising:

a striker plate having an opening adapted to receive a lock bolt, and the striker plate having two holes;

a slidable member for adjusting the striker plate in a horizontal direction, the slidable member adapted within the channel, the slidable member having two oblong holes;

an adjustable member for adjusting the striker plate in a vertical direction, the adjustable member adapted within the channel, the adjustable member having two threaded holes;

two fasteners passing through the two holes in the striker plate and passing through the two oblong holes in the slidable member and into the two threaded holes in the adjustable member; and a cam rotatably coupled to the adjustable member for horizontally adjusting the adjustable member and holding the adjustable member in place;

positioning the striker plate assembly in the vertical direction by sliding the striker plate assembly within the channel;

adjusting the striker plate assembly in the horizontal direction by inserting a tool into a slot in the cam and rotating the cam until a desired location is achieved; and tightening the two fasteners, thereby holding the striker plate assembly in position by holding the adjustable member against the slidable member and by holding the slidable member against the channel.

10. The method for adjusting a striker of claim 9, wherein the slidable member and the adjustable member and the cam are made from nylon.

11. The method for adjusting a striker of claim 10, the adjustable member further comprising two threaded metal inserts for accepting the two fasteners.

12. The method for adjusting a striker of claim 9, wherein the channel is formed of extruded metal and the channel is affixed to the side edge of the inactive door.

13. The method for adjusting a striker of claim 9, wherein the channel is formed in the side edge of the inactive door.

14. An adjustable striker plate system for an inactive door of a double door, the system comprising:

a channel within a side edge of the inactive door, the side edge interfacing with an active door of the double door;

a striker plate having an opening adapted to receive a lock bolt, the striker plate having two holes;

a slidable member for adjusting the striker plate in a horizontal direction, the slidable member having two oblong holes;

an adjustable member for adjusting the striker plate in a vertical direction, the adjustable member having two threaded holes;

a pair of fasteners passing through the two holes in the striker plate and passing through the two oblong holes in the slidable member and into the two threaded holes in the adjustable member; and a cam rotatably coupled to the fixed member for holding the fixed member in place while the pair of fasteners is tightened, the slidable member being forced against the channel when the two fasteners are tightened.

15. The adjustable striker plate system of claim 14, wherein the cam has a slot adapted to accept a tool for rotating the cam.

16. The adjustable striker plate system of claim 15, wherein the slidable member and the adjustable member and the cam are made from nylon.

17. The adjustable striker plate system of claim 16, the adjustable member further comprising two threaded metal inserts for accepting the two fasteners.

18. The adjustable striker plate system of claim 14, wherein the channel is formed of extruded metal and the channel is affixed to the side edge of the inactive door.

19. The adjustable striker plate system of claim 14, wherein the channel is formed on the side edge of the inactive door.

* * * * *